US011367981B2

(12) United States Patent
Oosaka

(10) Patent No.: US 11,367,981 B2
(45) Date of Patent: Jun. 21, 2022

(54) BOARD-TO-BOARD CONNECTOR AND MOUNTING STRUCTURE THEREFOR

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/079,944

(22) Filed: Oct. 26, 2020

(65) Prior Publication Data

US 2021/0167555 A1 Jun. 3, 2021

(30) Foreign Application Priority Data

Dec. 3, 2019 (JP) ..... JP2019-218934

(51) Int. Cl.
*H01R 13/6594* (2011.01)
*H01R 12/71* (2011.01)
(Continued)

(52) U.S. Cl.
CPC ..... *H01R 13/6594* (2013.01); *H01R 12/716* (2013.01); *H01R 12/73* (2013.01);
(Continued)

(58) Field of Classification Search
CPC .. H01R 13/6594; H01R 12/716; H01R 12/73; H01R 13/405; H01R 13/504;
(Continued)

(56) References Cited

U.S. PATENT DOCUMENTS 10,601,182 B2 * 3/2020 Horino ..... H01R 13/6582
2017/0033510 A1 2/2017 Ozeki
2019/0097360 A1 * 3/2019 Chen ..... H01R 4/028

FOREIGN PATENT DOCUMENTS

CN 209948108 U 1/2020
JP 2017-33654 A 2/2017
(Continued)

OTHER PUBLICATIONS

Office Action issued by Taiwan Intellectual Property Office (TIPO) for Taiwanese Patent Application No. 109137429, dated Jul. 28, 2021, along with an English language translation thereof.

*Primary Examiner* — Abdullah A Riyami
*Assistant Examiner* — Justin M Kratt
(74) *Attorney, Agent, or Firm* — Greenblum & Bernstein, P.L.C.

(57) ABSTRACT

A board-to-board connector includes a first connector and a second connector. The first connector includes a first shell which has four side wall portions arranged like a square frame. The second connector includes a second shell which has four side wall portions arranged like a square frame. In a state in which the first and second connectors are connected to each other, the second shell is fit inside the first shell. For a pair consisting of one arbitrarily selected side wall portion of the four side wall portions of the first shell and one side wall portion, corresponding to the one selected side wall portion, of the four side wall portions of the second shell, one side wall portions of the pair has a protruding portion which extends linearly along the one side wall portion, and the other side wall portion of the pair does not have the protruding portion.

20 Claims, 15 Drawing Sheets

(51) Int. Cl.

| | |
|---|---|
| ***H01R 13/6582*** | (2011.01) |
| ***H01R 12/73*** | (2011.01) |
| ***H01R 13/6581*** | (2011.01) |
| ***H01R 13/405*** | (2006.01) |
| ***H01R 13/504*** | (2006.01) |
| *H01R 107/00* | (2006.01) |
| *H01R 12/70* | (2011.01) |
| *H01R 12/52* | (2011.01) |
| *H01R 12/57* | (2011.01) |

(52) U.S. Cl.
CPC ..... *H01R 13/405* (2013.01); *H01R 13/504* (2013.01); *H01R 13/6581* (2013.01); *H01R 13/6582* (2013.01); *H01R 12/52* (2013.01); *H01R 12/57* (2013.01); *H01R 12/707* (2013.01); *H01R 12/71* (2013.01); *H01R 12/712* (2013.01); *H01R 2107/00* (2013.01)

(58) Field of Classification Search
CPC ..... H01R 13/6581; H01R 13/6582; H01R 12/52; H01R 12/57; H01R 12/707; H01R 12/71; H01R 12/712; H01R 2107/00
See application file for complete search history.

(56) References Cited

FOREIGN PATENT DOCUMENTS

| | | |
|---|---|---|
| TW | M372545 U | 1/2010 |
| TW | M577190 U | 4/2019 |

* cited by examiner

BOARD-TO-BOARD CONNECTOR AND MOUNTING STRUCTURE THEREFOR

TECHNICAL FIELD

This invention relates to a board-to-board connector and a mounting structure in which two connectors constituting the board-to-board connector are attached to two boards.

BACKGROUND ART

A board-to-board connector includes a first connector and a second connector. The first connector is attached to one surface of a first board while the second connector is attached to one surface of a second board. The first connector and the second connector fit together with the one surface of the first board and the one surface of the second board facing each other. The board-to-board connector electrically connects the first board and the second board.

As a conventional art, a board-to-board connector disclosed in Japanese Patent Application Laid Open No. 2017-33654 is shown in FIGS. 1A, 1B, 2A, 2B, and 3. The shown board-to-board connector includes a first connector 10 and a second connector 20.

The first connector 10 includes an elongated insulating housing 11, and the second connector 20 includes an elongated insulating housing 21. Signal contacts 13 are arrayed at predetermined intervals along a length direction of the insulating housing 11. Signal contacts 23 are arrayed at predetermined intervals along a length direction of the insulating housing 21.

The insulating housing 11 includes proximal end portions lla at two ends in the length direction of the insulating housing 11 (that is, a length direction of the board-to-board connector), and the insulating housing 21 includes proximal end portions 21*a* at two ends in the length direction of the insulating housing 21 (that is, the length direction of the board-to-board connector). The insulating housing 11 includes an elongated central protruding portion 11*b* which is formed in a region between the two proximal end portions 11*a*, and the insulating housing 21 includes an elongated central recessed portion 21*b* which is formed in a region between the two proximal end portions 21*a*.

A conductive shell 12 is placed around an outer peripheral portion of the insulating housing 11 and surrounds the outer peripheral portion of the insulating housing 11. The conductive shell 12 functions as a shielding wall portion for the signal contacts 13. A conductive shell 22 is placed around an outer peripheral portion of the insulating housing 21 and surrounds the outer peripheral portion of the insulating housing 21. The conductive shell 22 functions as a shielding wall portion for the signal contacts 23. Reference numerals 14 and 24 denote power contacts.

The conductive shell 12 is composed of two metal components. The two metal components each have an L-shape. The two components form a frame structure of the conductive shell 12. One or more ground connecting portions 12*c* are formed at each of a lower end edge portion of a wall plate 12*a* along a length direction of the conductive shell 12 and a lower end edge portion of a wall plate 12*b* along a width direction. Each ground connecting portion 12*c* is joined with solder to a ground pad which is formed at a first wiring board 15.

Ground connecting portions 12*c* which are formed at the wall plate 12*a* along the length direction of the conductive shell 12 are arranged at fixed intervals. An inspection window 12*d* is formed between each two adjacent ground connecting portions 12*c*. Through the inspection window 12*d*, a leg portion 13*a* of the signal contact 13 can be viewed. That is, a status of connection between the leg portions 13*a* and the first wiring board 15 or a connector assembly status can be confirmed. In this example, a length of the inspection window 12*d* in the length direction of the board-to-board connector corresponds to a length of a range including three leg portions 13*a* in a row.

A planar cover 12*e* links with an upper edge portion of the wall plate 12*a* along the length direction of the conductive shell 12. Contact pieces 12*f* are formed at fixed intervals at sites astride a boundary between the wall plate 12*a* and the planar cover 12*e*. Each contact piece 12*f* is formed by cutting a part of a metal component and slightly raising a cut portion. The contact piece 12*f* is a metal piece in a plate spring shape which can make elastic contact with the conductive shell 22 of the second connector 20.

The conductive shell 22 is composed of two metal components. The two metal components each have a staple shape. The two components form a frame structure of the conductive shell 22. One or more ground connecting portions 22*c* are formed at each of a lower end edge portion of a wall plate 22*a* along a length direction of the conductive shell 22 and a lower end edge portion of a fixing and locking piece (that is, a wall plate along a width direction) 22*b*. Each ground connecting portion 22*c* is joined with solder to a ground pad which is formed at a second wiring board 25.

Ground connecting portions 22*c* which are formed at the wall plate 22*a* along the length direction of the conductive shell 22 are arranged at fixed intervals. An inspection window 22*d* is formed between each two adjacent ground connecting portions 22*c*. Through the inspection window 22*d*, a leg portion 23*a* of the signal contact 23 can be viewed. That is, a status of connection between the leg portions 23*a* and the second wiring board 25 or a connector assembly status can be confirmed. In this example, a length of the inspection window 22*d* in the length direction of the board-to-board connector corresponds to a length of a range including three leg portions 23*a* in a row.

In a state in which the first connector 10 attached to the first wiring board 15 and the second connector 20 attached to the second wiring board 25 fit together, the signal contacts 23 and the power contacts 24 of the second connector 20 are in contact with the signal contacts 13 and the power contacts 14 of the first connector 10. This results in mutual electrical connection between the first wiring board 15 and the second wiring board 25.

In the state in which the first connector 10 and the second connector 20 fit together, the conductive shell 22 of the second connector 20 lies over the whole of the first connector 10 (see FIG. 3). An inner wall surface of the conductive shell 22 of the second connector 20 is in elastic contact with the contact pieces 12*f* of the conductive shell 12 of the first connector 10. Thus, the conductive shell 12 and the conductive shell 22 are electrically connected to each other via the contact pieces 12*f*.

Along with miniaturization and densification of an electronic device using a board-to-board connector and use of a high-frequency electrical signal, measures against electromagnetic interference (EMI) for a board-to-board connector are required.

As for the above-described board-to-board connector according to the conventional art, a shielding effect is not necessarily good due to at least one of the three points below.

First, a void is present around the contact piece 12*f* for implementing electrical connection between the conductive shell 12 and the conductive shell 22. Thus, the shielding effect is not necessarily good.

Second, in the state in which the first connector 10 and the second connector 20 fit together, there is a gap between the conductive shell 12 and the conductive shell 22 except at portions of contact between the contact pieces 12*f* and the conductive shell 22. Thus, the shielding effect is not necessarily good.

Third, the conductive shell 12 and the conductive shell 22 have the inspection windows 12*d* and 22*d*. Thus, the shielding effect is not necessarily good.

BRIEF SUMMARY OF THE INVENTION

An object of this invention is to provide a board-to-board connector capable of obtaining a more potent shielding effect than in the conventional art and a mounting structure in which two connectors constituting the board-to-board connector are attached to two boards.

The following technical matters are described simply to facilitate the understanding of the main points of the present invention, not to limit the invention claimed in the claims explicitly or implicitly and not to express the possibility of accepting such a limitation that is imposed by a person other than those who will benefit from the present invention (for example, the applicant and the right holder). The general outline of the present invention described from other perspectives can be understood from, for example, the claims of this application as originally filed at the time of application. A board-to-board connector disclosed herein includes a first connector and a second connector.

The first connector includes a first shell which has four side wall portions arranged like a square frame. The second connector includes a second shell which has four side wall portions arranged like a square frame. In a state in which the first connector and the second connector are connected to each other, the second shell is fit inside the four side wall portions of the first shell, and the four side wall portions of the first shell and the four side wall portions of the second shell are in one-to-one contact with each other.

For any pair of two side wall portions, one of which is arbitrarily selected from among the four side wall portions of the first shell and the other of which is one of the four side wall portions of the second shell and which corresponds to the selected side wall portion, one of the two side wall portions has a protruding portion which extends linearly along the one side wall portion, and the other side wall portion does not have such a protruding portion.

A mounting structure for the board-to-board connector disclosed herein has a structure in which the first connector is attached to the first board and the second connector is attached to the second board. In this structure, a gap between the first board and the first connector is filled with solder, and a gap between the second board and the second connector is filled with solder. Specifically, at least one outer wall portion of the four outer wall portions of the above-described first shell has a first end edge and a first recessed portion formed at the first end edge, the first end edge except for the first recessed portion being in contact with the first board and the first recessed portion being for viewing an end portion of a contact which the first connector has. Additionally, at least one side wall portion of the four side wall portions of the above-described second shell has a second end edge and a second recessed portion formed at the second end edge, the second end edge except for the second recessed portion being in contact with the second board and the second recessed portion being for viewing an end portion of a contact which the second connector has. The first recessed portion and the second recessed portion are filled with solder.

These and other objects, features and advantages of the present invention will become apparent from the detailed description taken in conjunction with the accompanying drawings.

Effects of the Invention

In the board-to-board connector according to this invention, a length, over which the four side wall portions of the first shell and the four side wall portions of the second shell are in contact with each other, is long due to the protruding portions extending along the square frame. A more potent shielding effect can thus be obtained than in the conventional art.

In the mounting structure for the board-to-board connector according to this invention, the recessed portions for viewing the end portions of the contacts are filled with solder. A more potent shielding effect can thus be obtained than in the conventional art.

BRIEF DESCRIPTION OF THE DRAWINGS

The subject matter, which is regarded as the invention, is particularly pointed out and distinctly claimed in the claims at the conclusion of the specification. The present invention itself, and manner in which it may be made or used, if any, may be better understood after a review of the following description in connection with the accompanying drawings in which:

LIST OF REFERENCE NUMERALS

Figure 1A:
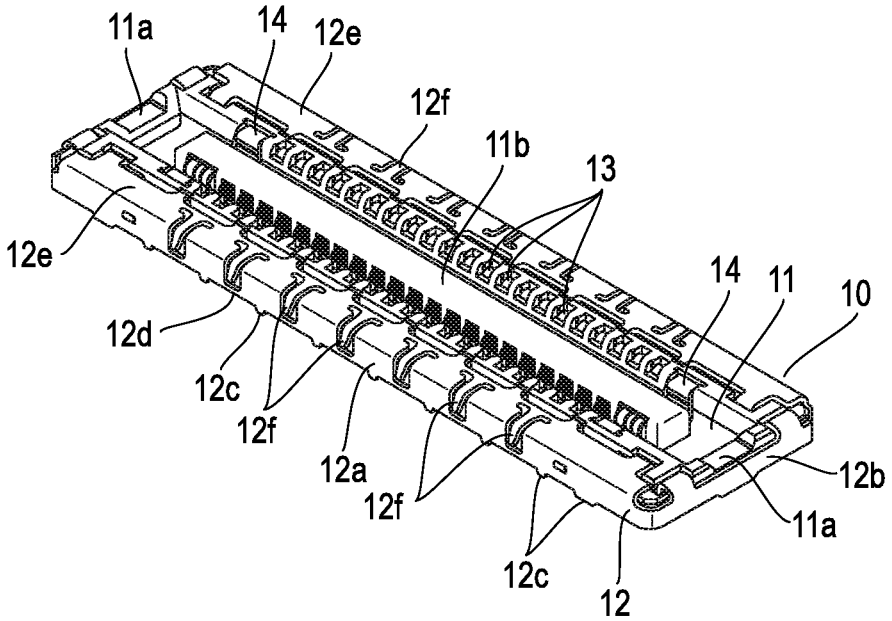
FIG. 1A (PRIOR ART)
FIG. 1A is a perspective view of a first connector included in a board-to-board connector according to a conventional art.
Figure 1B:
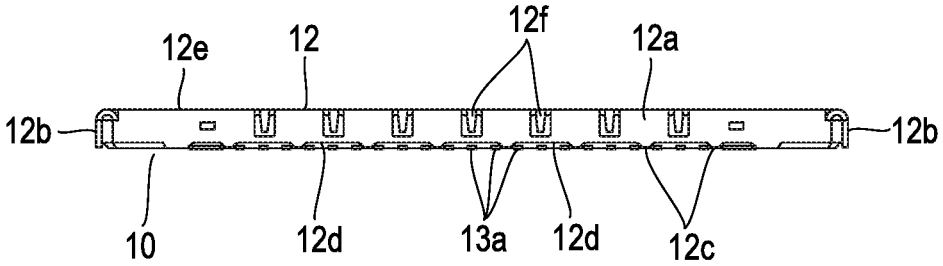
FIG. 1B (PRIOR ART)
FIG. 1B is a front view of the first connector shown in FIG. 1A.
Figure 2A:
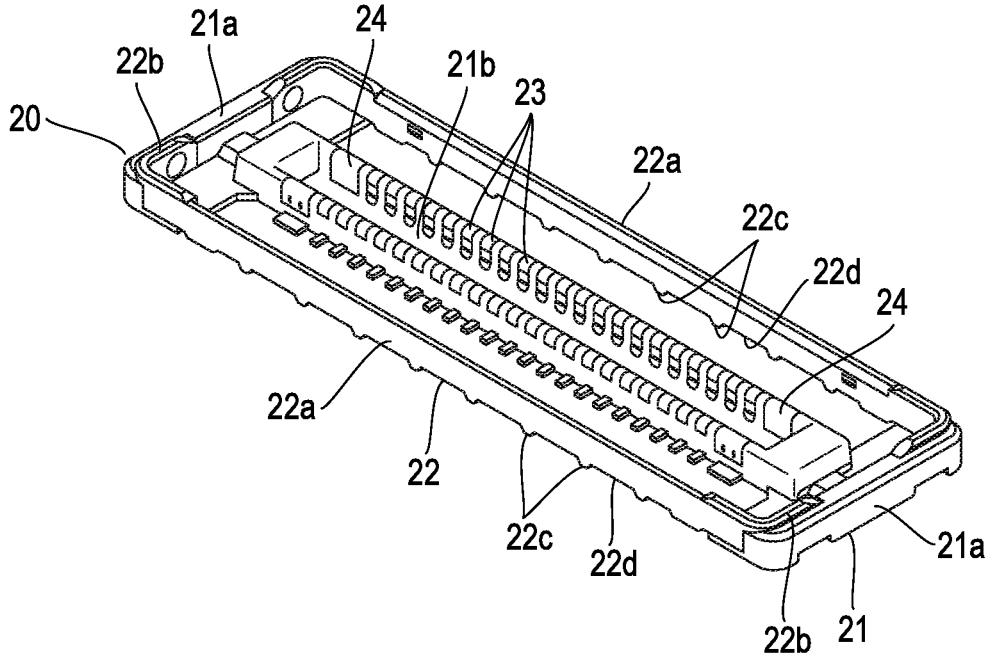
FIG. 2A (PRIOR ART)
FIG. 2A is a perspective view of a second connector included in the board-to-board connector according to the conventional art.
Figure 2B:
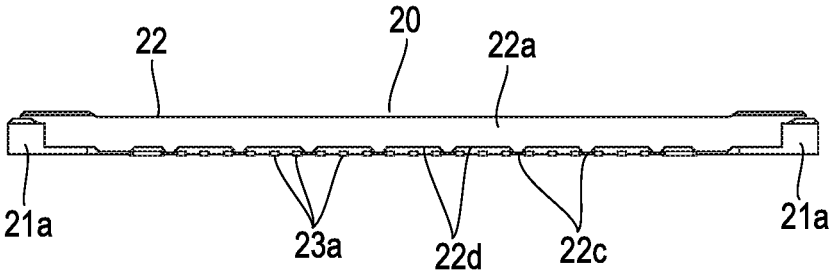
FIG. 2B (PRIOR ART)
FIG. 2B is a front view of the second connector shown in FIG. 2A.
Figure 3:
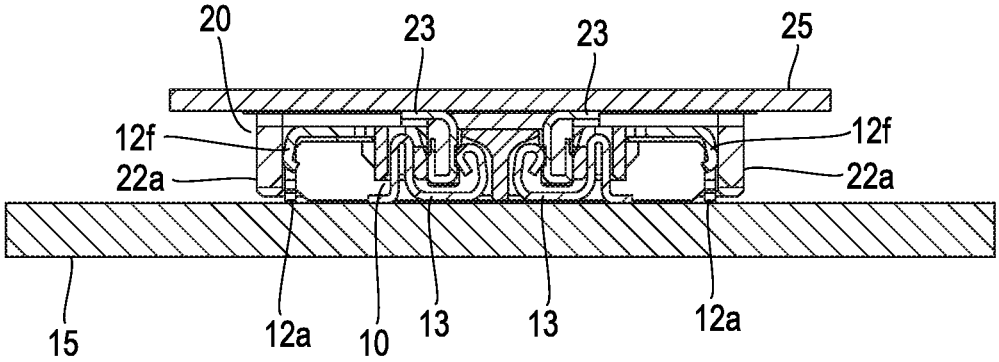
FIG. 3 (PRIOR ART)
FIG. 3 is an enlarged sectional view showing a state in which the first connector shown in FIG. 1A and the second connector shown in FIG. 2A fit together, together with wiring boards.
Figure 4A:
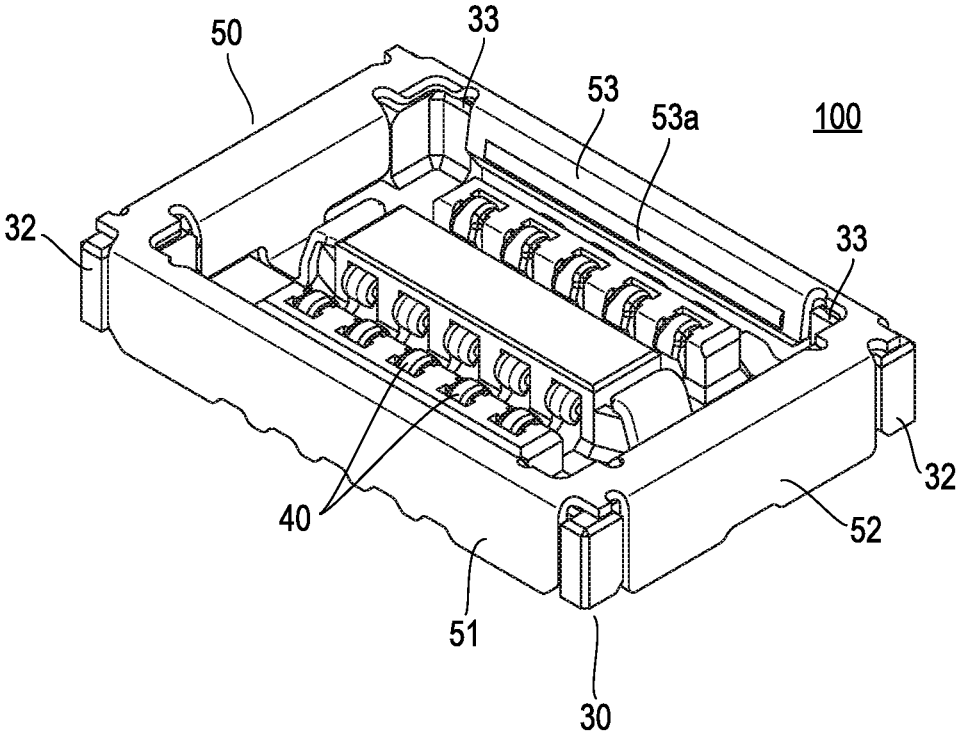
FIG. 4A is a perspective view of a first connector included in a board-to-board connector according to an embodiment when viewed from above.
Figure 4B:
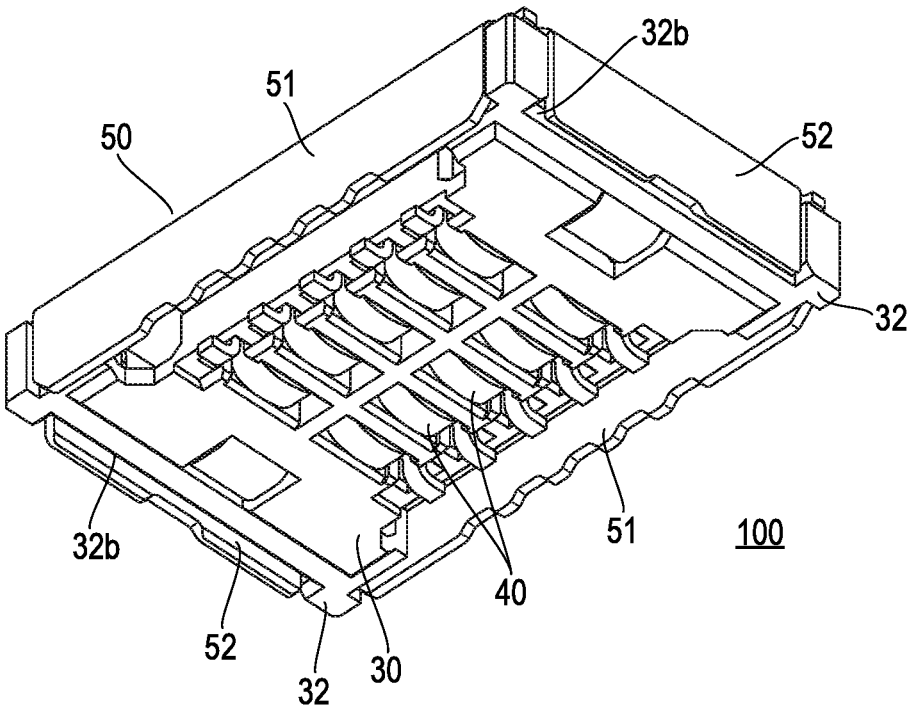
FIG. 4B is a perspective view of the first connector shown in FIG. 4A when viewed from below.

With regard to reference numerals used, the following numbering is used throughout the drawings.

10: first connector
11: insulating housing
11*a*: proximal end portion
11*b*: central protruding portion
12: conductive shell
12*a*: wall plate
12*b*: wall plate
12*c*: ground connecting portion
12*d*: inspection window
12*e*: planar cover
12*f*: contact piece
13: signal contact
13*a*: leg portion
14: power contact
15: first wiring board
20: second connector
21: insulating housing
21*a*: proximal end portion
21*b*: central recessed portion
22: conductive shell
22*a*: wall plate
22*b*: fixing and locking piece
22*c*: ground connecting portion
22*d*: inspection window
23: signal contact
23*a*: leg portion
24: power contact
25: second wiring board
30: first insulator
31: bottom plate portion
31*a*: opening
31*b*: hole
31*c*: lower surface
31*d*: recessed portion
32: side wall
32*a*, 32*b*: recessed portion
33: extension wall
34: central protruding portion
34*a*: recessed portion
35: protruding portion
35*a*: recessed portion
36: step portion
36*a*: hole
40: first contact
41: end portion
42: body portion
43: U-shaped portion
44: contact portion
45: protuberant portion
50: first shell
51: outer wall portion
51*a*: recessed portion
51*b*: ground connecting portion
52: outer wall portion
52*a*: recessed portion
52*b*: ground connecting portion
53: side wall portion
53*a*: protruding portion
54: side wall portion
54*a*: projection
55: coupling portion
56: arm portion
56*a*: distal end portion
60: second insulator
61: bottom plate portion
62: side wall
62*a*: recessed portion
62*b*: step portion
63: holding wall
64: recessed portion
70: second contact
71: end portion
72: U-shaped portion
80: second shell
81: side wall portion
81*a*: groove
81*b*: recessed portion
81*c*: ground connecting portion
82: outer wall portion
82*a*: protruding portion
82*b*: recessed portion
82*c*: ground connecting portion
82*d*: projection
83: coupling portion
83*a*: recessed portion
90: solder region
91: solder region
100: first connector
200: first board
300: second connector
400: second board
500: board-to-board connector

DETAILED DESCRIPTION

Referring to the drawings, an embodiment of this invention will be described. A board-to-board connector 500 according to the embodiment includes a first connector 100 and a second connector 300.

(First Connector)

The first connector 100 will be described with reference to FIGS. 4A, 4B, 5A, 5B, 6, 7A, 7B, 8A, and 8B. The first connector 100 includes a first insulator 30, first contacts 40 (in this example, the number of the first contacts 40 is ten) which are held by the first insulator 30, and a first shell 50 which is attached to the first insulator 30.

The first insulator 30 is made of resin. The first insulator 30 includes a rectangular bottom plate portion 31 and two side walls 32 in this example (see FIGS. 7A and 7B). The two side walls 32 are located at two ends of the bottom plate portion 31 in a length direction of the bottom plate portion 31.

A recessed portion 32*a* is formed at an inner side surface of each of the two side walls 32, and a recessed portion 32*b* is formed at an outer side surface of each of the two side walls 32. Two extension walls 33 protrude inward from two sites located slightly inside two ends, in a length direction of the side wall 32, of the inner side surface of the side wall 32. A width of a portion of the bottom plate portion 31 which is located between the extension walls 33 located at one side wall 32 and the extension walls 33 located at the other side wall 32 is slightly smaller than a width of each of two end portions of the bottom plate portion 31.

A central protruding portion 34 protrudes from an upper surface of a central portion of the portion having the slightly smaller width of the bottom plate portion 31. The central protruding portion 34 extends in the length direction of the bottom plate portion 31. A protruding portion 35 protrudes from each of two side sites of the bottom plate portion 31. The two side sites of the bottom plate portion 31 are located at sides of the central protruding portion 34 in a width direction of the central protruding portion 34. The protruding portions 35 extend in the length direction of the bottom plate portion 31.

A step portion 36 slightly lower in height than the central protruding portion 34 is formed at each of two ends of the central protruding portion 34 in a length direction of the central protruding portion 34. A hole 36*a* which opens upward is formed in each step portion 36. An opening 31*a* is formed in a site of the bottom plate portion 31 which is located between the step portion 36 and the side wall 32.

Recessed portions 35*a* (in this example, the number of the recessed portions 35*a* is five) are formed at predetermined intervals at a side surface, facing the central protruding portion 34, of one protruding portion 35. Recessed portions 35*a* (in this example, the number of the recessed portions 35*a* is five) are formed at the predetermined intervals at a side surface, facing the central protruding portion 34, of the other protruding portion 35. Recessed portions 34*a* (in this example, the number of the recessed portions 34*a* is five) are formed at predetermined intervals at a side surface, facing the one protruding portion 35, of the central protruding portion 34, and recessed portions 34*a* (in this example, the number of the recessed portions 34*a* is five) are formed at the predetermined intervals at a side surface, facing the other protruding portion 35, of the central protruding portion 34. That is, in this example, the first insulator 30 includes ten recessed portions 34*a* and ten recessed portions 35*a*. The ten recessed portions 34*a* correspond one-to-one to the ten recessed portions 35*a*. One recessed portion 34*a* and one recessed portion 35*a* corresponding to each other face each other. That is, assuming one recessed portion 34*a* and one recessed portion 35*a* corresponding to each other as one pair, the first insulator 30 includes ten pairs in this example. Ten holes 31*b* are formed in the bottom plate portion 31, and the ten holes 31*b* correspond one-to-one to the ten pairs. One hole 31*b* arbitrarily selected from among the ten holes 31*b* communicates with one recessed portion 34*a* and one recessed portion 35*a* which constitute one pair corresponding to the one selected hole 31*b*. Each recessed portion 35*a* has an opening portion at an upper surface of the protruding portion 35. An array of recessed portions 31*d* corresponding to an array of holes 31*b* is formed at each end of the lower surface 31*c* in a width direction of the bottom plate portion 31. One hole 31*b* arbitrarily selected from among the ten holes 31*b* communicates with the recessed portion 31*d* corresponding to the selected hole 31*b*.

Figure 5A:
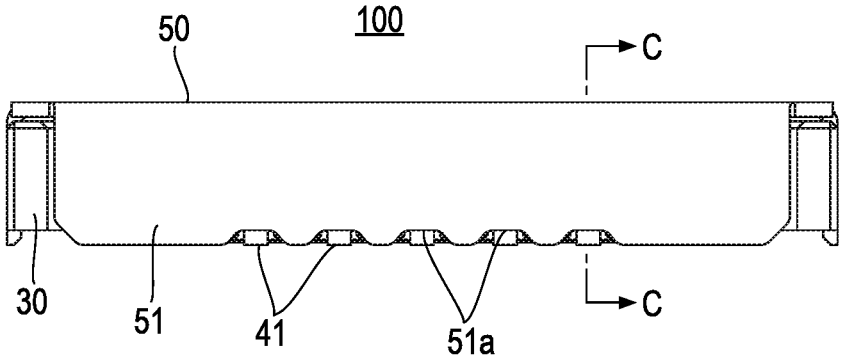
FIG. 5A is an enlarged front view of the first connector shown in FIG. 4A.
Figure 5B:
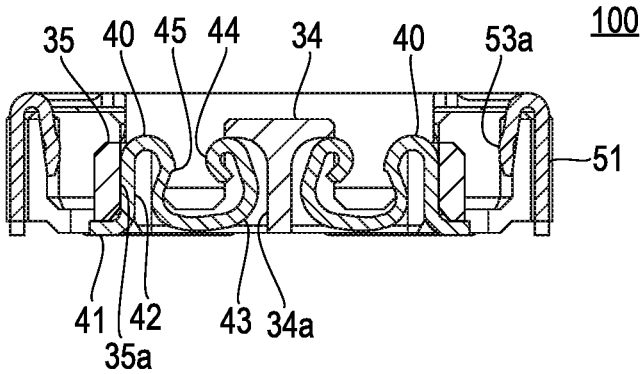
FIG. 5B is a sectional view taken along line C-C in FIG. 5A.

Each first contact 40 is a thin metal piece which is bent at two or more sites and includes an end portion 41, a body portion 42 which links perpendicularly with the end portion 41, and a U-shaped portion 43 which links with the body portion 42 (see FIG. 5B). A contact portion 44 which is bent inward is formed at a distal end of the U-shaped portion 43. A protuberant portion 45 is formed at a proximal end portion (that is, a portion close to a boundary between the body portion 42 and the U-shaped portion 43) of the U-shaped portion 43 which faces the contact portion 44. The protuberant portion 45 faces the contact portion 44.

The first contact 40 is attached to the first insulator 30 by inserting the first contact 40 into the hole 31*b*. Although not shown in detail, a projection is formed at the body portion 42. The first contact 40 is fixed to the first insulator 30 by pushing the body portion 42 into the recessed portion 35*a*. A site close to the contact portion 44 of the U-shaped portion 43 is located in the recessed portion 34*a* of the central protruding portion 34.

Figure 8A:
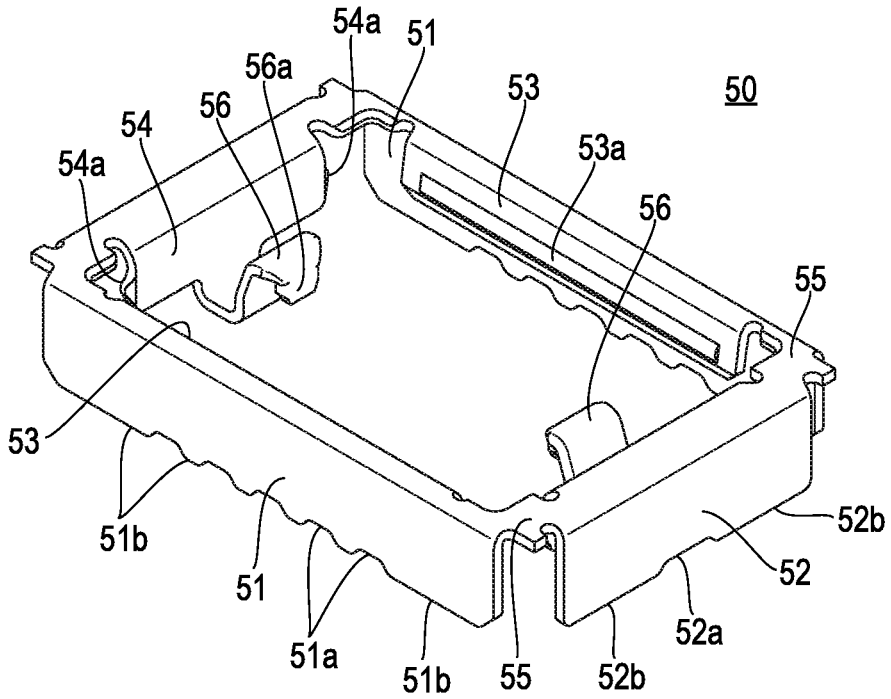
FIG. 8A is a perspective view of a first shell included in the first connector when viewed from above.
Figure 8B:
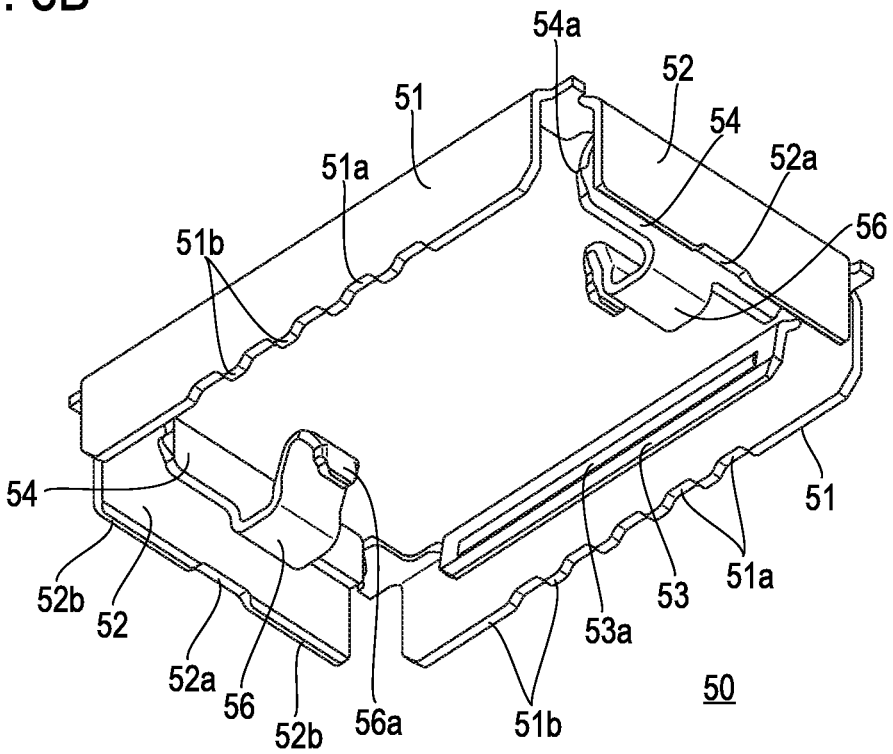
FIG. 8B is a perspective view of the first shell shown in FIG. 8A when viewed from below.
Figure 9A:
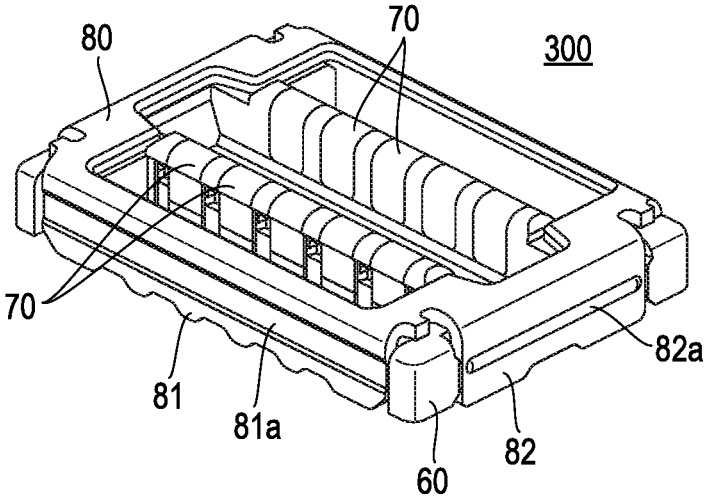
FIG. 9A is a perspective view of a second connector included in the board-to-board connector according to the embodiment when viewed from above.
Figure 9B:
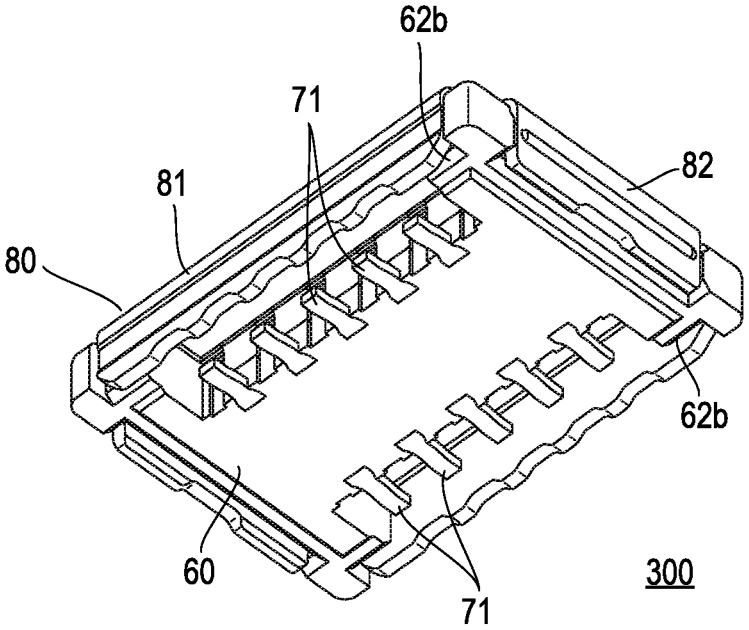
FIG. 9B is a perspective view of the second connector shown in FIG. 9A when viewed from below.

The first shell 50 in the shape of a square frame that has conductivity is formed by bending of a metal plate. As shown in FIGS. 8A and 8B, the first shell 50 includes two outer wall portions 51 which are located at long sides of the square frame, two outer wall portions 52 which are located at short sides of the square frame, two side wall portions 53 which are located inside the two outer wall portions 51 and link with upper peripheral edges of the two outer wall portions 51, and two side wall portions 54 which are located inside the two outer wall portions 52 and link with upper peripheral edges of the two outer wall portions 52. The outer wall portion 51 and the outer wall portion 52 adjacent to each other are coupled at upper ends of them by a coupling portion 55.

Five recessed portions 51*a* having small depths are formed at predetermined intervals in a length direction of the outer wall portion 51 at a lower end of the outer wall portion 51. An array interval for the recessed portions 51*a* is equal to an array interval for five first contacts 40. One recessed portion 52*a* having a small depth is formed at a lower end of the outer wall portion 52. The lower end of the outer wall portion 51 except the recessed portions 51*a* serves as ground connecting portions 51*b*. The lower end of the outer wall portion 52 except the recessed portion 52*a* serves as ground connecting portions 52*b*.

The two side wall portions 53 function as spring pieces supported by the outer wall portions 51 in this example. An elongated protruding portion 53*a* which extends linearly in a length direction of the side wall portion 53 is formed at an inner side surface of the side wall portion 53. The protruding portion 53*a* extends from a site near one end of the side wall portion 53 to a site near the other end in this example. A shape of the protruding portion 53*a* in a cross-section orthogonal to the length direction of the side wall portion 53 is a semi-elliptical arc.

Two projections 54*a* are formed at two ends of one side wall portion 54 in a length direction of the one side wall portion 54. Similarly, two projections 54*a* are formed at two ends of the other side wall portion 54 in the length direction of the other side wall portion 54. An arm portion 56 extends from a central portion of a lower end of the side wall portion 54. The arm portion 56 is a strip-shaped portion which is bent at two or more sites. The arm portion 56 extends from the lower end of the side wall portion 54 toward an inside of the first shell 50, bends toward above the first shell 50, extends toward the inside of the first shell 50, and extends toward below the first shell 50.

In the first shell 50, a gap between the outer wall portion 51 and the outer wall portion 52 adjacent to each other is preferably made as narrow as possible. Similarly, a gap between the side wall portion 53 and the side wall portion 54 adjacent to each other is preferably made as narrow as possible.

The first shell 50 is attached to the first insulator 30 by pushing the first shell 50 against the first insulator 30 after putting the first shell 50 on the first insulator 30. In this process, the side wall portion 54 having the projections 54*a* is pushed into the recessed portion 32*a* of the side wall 32 of the first insulator 30, and a distal end portion 56*a* of the arm portion 56 is pushed into the hole 36*a* of the step portion 36 of the first insulator 30. This results in completion of the first connector 100.

The outer wall portions 51 are located outside the extension walls 33, and the outer wall portions 52 are located in the recessed portions 32*b* of the side walls 32. That is, the first shell 50 is an outer shell of the first connector 100. The side wall portions 53 as spring pieces are located inside the extension walls 33 and are elastically pliable.

Figure 6:
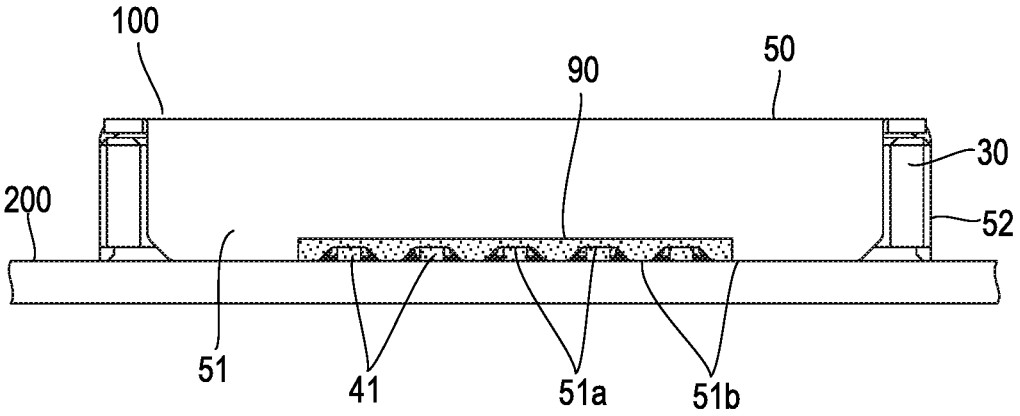
FIG. 6 is a front view showing a state in which the first connector shown in FIG. 4A is attached to a first board.
Figure 7A:
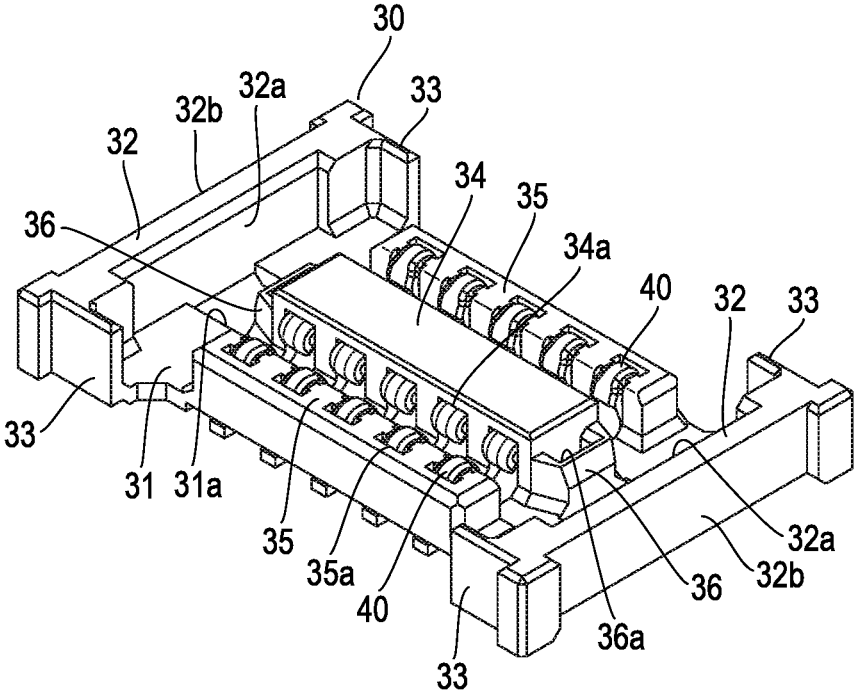
FIG. 7A is a perspective view of a first insulator included in the first connector and first contacts held by the first insulator when viewed from above.
Figure 7B:
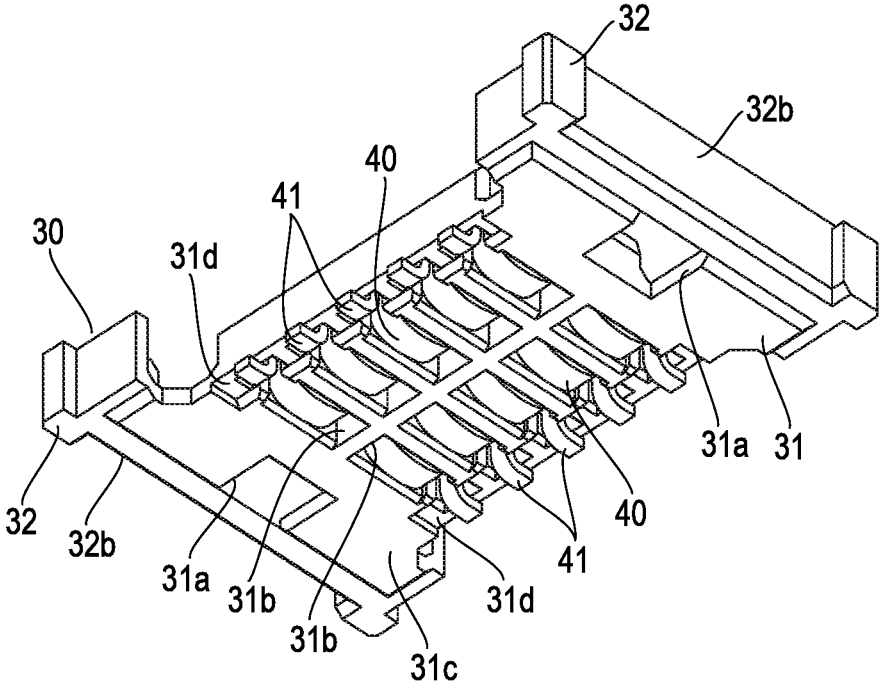
FIG. 7B is a perspective view of the first insulator shown in FIG. 7A when viewed from below.

Although not shown in detail, the end portion 41 of the first contact 40 is soldered to a pad of a first board 200, and the ground connecting portions 51*b* and 52*b* of the outer wall portions 51 and 52 are soldered to a ground pad of the first board 200 (see FIG. 6).

As shown in FIG. 5A, the end portion 41 of the first contact 40 can be viewed from outside the outer wall portion 51 through the recessed portion 51*a*. A position or a soldering condition of the end portion 41 can be confirmed, which ensures good mounting of the first connector 100. After the first connector 100 is mounted on the first board 200, all recessed portions 51*a* and 52*a* of the outer wall portions 51 and 52 are filled with solder. A region denoted by reference numeral 90 in FIG. 6 is a solder region.

(Second Connector)

The second connector 300 will be described with reference to FIGS. 9A, 9B, 10A, 10B, 11, 12A, 12B, 13A, and 13B.

The second connector 300 includes a second insulator 60, second contacts 70 (in this example, the number of the second contacts 70 is ten) which are held by the second insulator 60, and a second shell 80 which is attached to the second insulator 60.

The second insulator 60 is made of resin. The second insulator 60 includes a rectangular bottom plate portion 61, two side walls 62, and two holding walls 63 in this example (see FIGS. 12A and 12B). The two side walls 62 are located at two ends, in a length direction of the bottom plate portion 61, of the bottom plate portion 61. The two holding walls 63 protrude upward from two ends, in a width direction of the bottom plate portion 61, of the bottom plate portion 61. The two holding walls 63 each extend from one side wall 62 to the other side wall 62.

A length of each side wall 62 in the width direction of the bottom plate portion 61 is larger than a width of the bottom plate portion 61. A recessed portion 62*a* is formed at an outer side surface of each of the two side walls 62. At portions (that is, portions close to the bottom plate portion 61) inside two ends of the side wall 62 in a length direction of the side wall 62, step portions 62*b* which are set back from the two ends are formed.

A height of each holding wall 63 is higher than a height of the side wall 62. A shape of an upper end face of each holding wall 63 in a cross-section orthogonal to a length direction of the holding wall 63 is a semi-elliptical arc. A recessed portion 64 which extends in the length direction of the bottom plate portion 61 is formed between the two holding walls 63. A bottom surface of the recessed portion 64 serves as the bottom plate portion 61. One end of the recessed portion 64 extends into one side wall 62, and the other end of the recessed portion 64 extends into the other side wall 62.

Figure 10A:
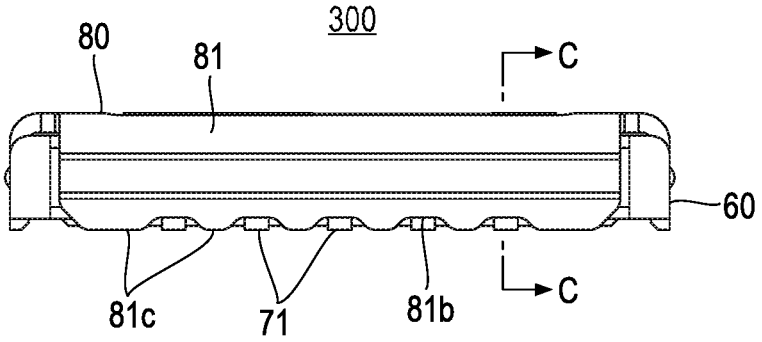
FIG. 10A is an enlarged front view of the second connector shown in FIG. 9A.
Figure 10B:
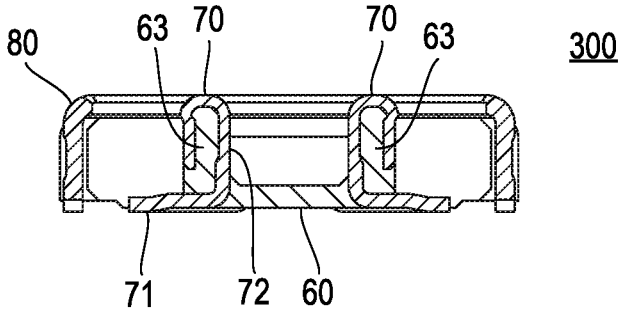
FIG. 10B is a sectional view taken along line C-C in FIG. 10A.

The second contact 70 includes an end portion 71 and a U-shaped portion 72 (see FIG. 10B). One end of the U-shaped portion 72 links with the end portion 71, and the other end of the U-shaped portion 72 faces the end portion 71. The second contact 70 is fixed to the second insulator 60 through insert molding in this example. In the example, five second contacts 70 are arrayed at predetermined intervals in the length direction of one holding wall 63 at the one holding wall 63. Similarly, five second contacts 70 are arrayed at the predetermined intervals in the length direction of the other holding wall 63 at the other holding wall 63. A bent portion of the U-shaped portion 72 is located on a plane where the upper end face of the holding wall 63 is located.

Figure 13A:
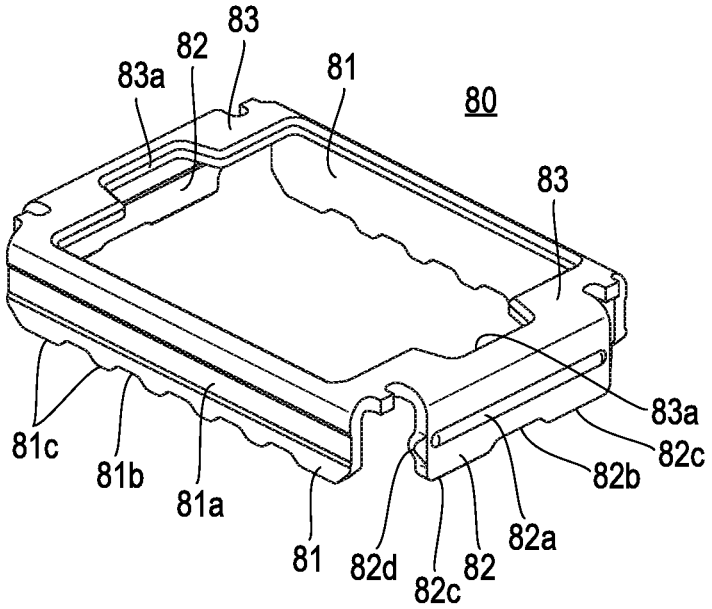
FIG. 13A is a perspective view of a second shell included in the second connector when viewed from above.
Figure 13B:
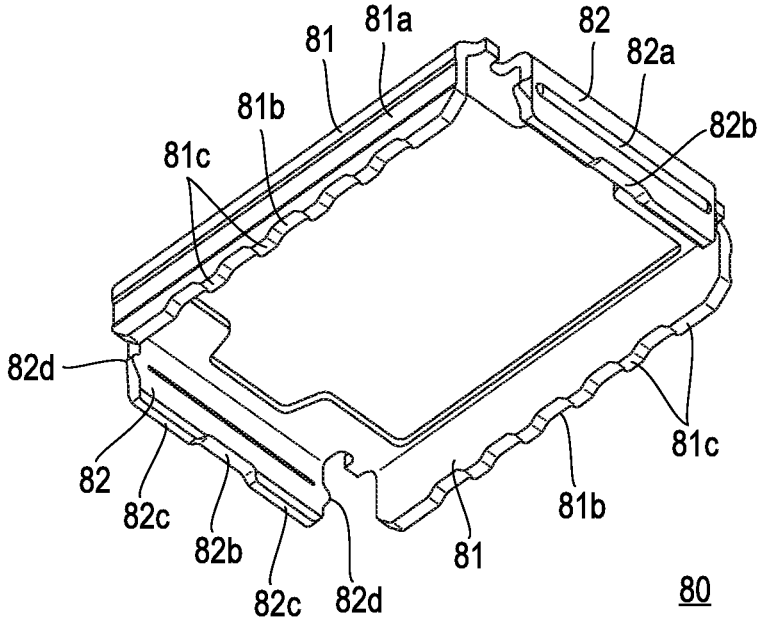
FIG. 13B is a perspective view of the second shell shown in FIG. 13A when viewed from below.
Figure 14A:
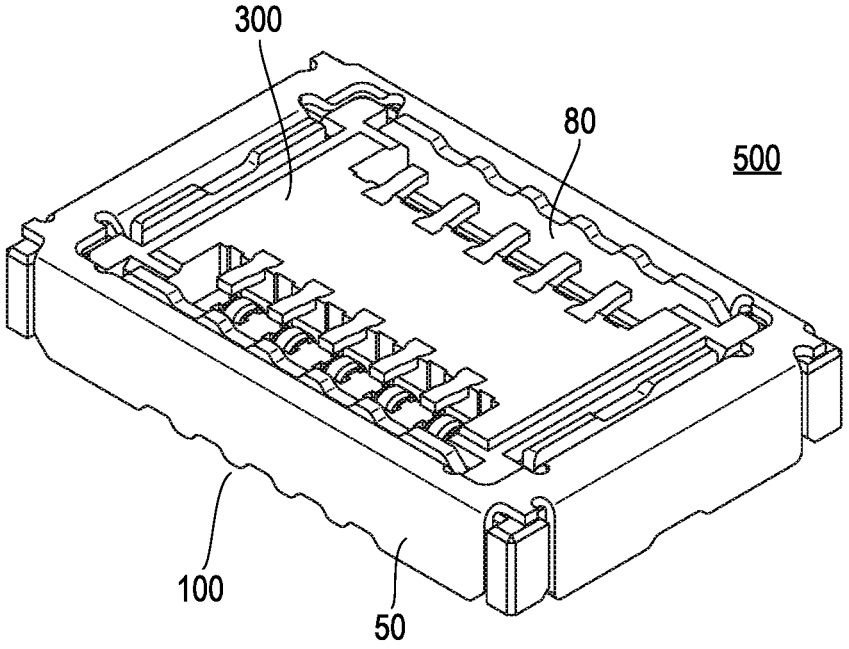
FIG. 14A is a perspective view of a structure in which the first connector shown in FIG. 4A and the second connector shown in FIG. 9A are connected to each other when viewed from above.
Figure 14B:
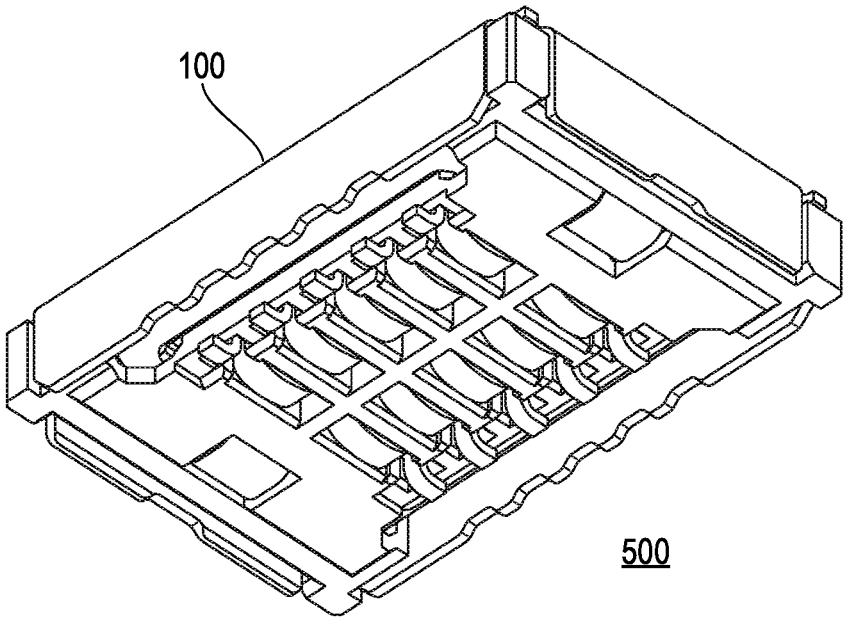
FIG. 14B is a perspective view of the structure of connection between the first connector and the second connector shown in FIG. 14A when viewed from below.
Figure 15A:
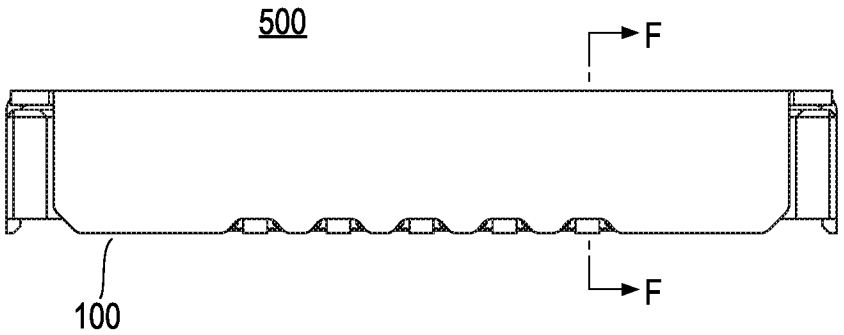
FIG. 15A is an enlarged front view of the structure of connection between the first connector and the second connector shown in FIG. 14A.
Figure 15B:
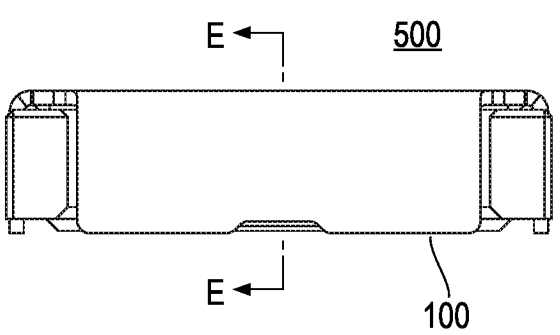
FIG. 15B is an enlarged side view of the structure of connection between the first connector and the second connector shown in FIG. 14A.
Figure 15C:
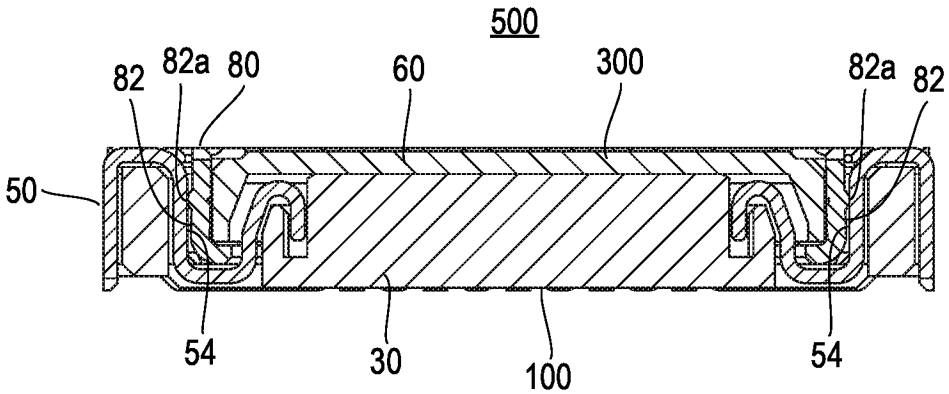
FIG. 15C is a sectional view taken along line E-E in FIG. 15B.
Figure 15D:
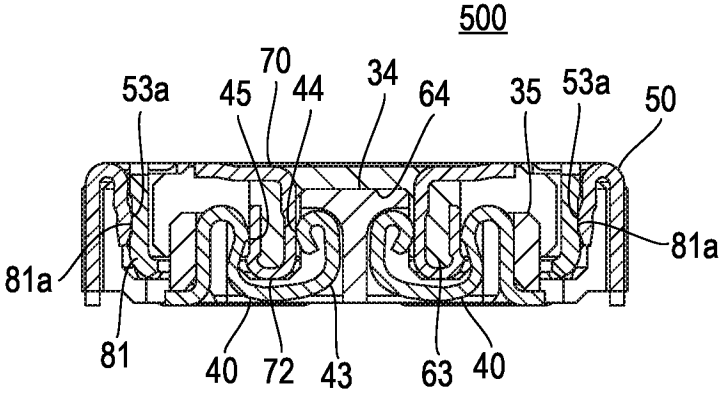
FIG. 15D is a sectional view taken along line F-F in FIG. 15A.

The second shell 80 in the shape of a square frame that has conductivity is formed by bending of a metal plate. As shown in FIGS. 13A and 13B, the second shell 80 includes two side wall portions 81 which are located at long sides of the square frame, two outer wall portions 82 which are located at short sides of the square frame, and two coupling portions 83 which are shaped like thin plates. One coupling portion 83 links with an upper end of one outer wall portion 82, and two ends of the one coupling portion 83 link with two ends of upper ends of the two side wall portions 81. The other coupling portion 83 links with an upper end of the other outer wall portion 82, and two ends of the other coupling portion 83 link with two ends of the upper ends of the two side wall portions 81. A recessed portion 83*a* is formed on a central inner side of each coupling portion 83.

A groove 81*a* which extends from one end in a length direction of the side wall portion 81 to the other end is formed in an outer side surface of each side wall portion 81. An elongated protruding portion 82*a* which extends linearly from a site near one end in a length direction of the outer wall portion 82 to a site near the other end is formed at an outer side surface of each outer wall portion 82. A surface shape of the protruding portion 82*a* in a cross-section orthogonal to the length direction of the outer wall portion 82 is a semi-elliptical arc.

Five recessed portions 81*b* having small depths are formed at predetermined intervals in the length direction of the side wall portion 81 at a lower end of the side wall portion 81. An array interval for the recessed portions 81*b* is equal to an array interval for five second contacts 70. One recessed portion 82*b* having a small depth is formed at a lower end of the outer wall portion 82. The lower end of the side wall portion 81 except the recessed portions 81*b* serves as ground connecting portions 81*c*. The lower end of the outer wall portion 82 except the recessed portion 82*b* serves as ground connecting portions 82*c*. Two projections 82*d* are formed at the two ends of one outer wall portion 82 in the length direction of the outer wall portion 82. Two projections 82*d* are formed at the two ends of the other outer wall portion 82 in the length direction of the outer wall portion 82.

In the second shell 80, a gap between the side wall portion 81 and the outer wall portion 82 adjacent to each other is preferably made as narrow as possible.

The second shell 80 is attached to the second insulator 60 by pushing the second shell 80 against the second insulator 60 after putting the second shell 80 on the second insulator 60. In this process, the outer wall portion 82 having the projections 82*d* is pushed into the recessed portion 62*a* of the side wall 62 of the second insulator 60. This results in completion of the second connector 300. The side wall portions 81 are located outside the step portions 62*b*. That is, the second shell 80 is an outer shell of the second connector 300.

Figure 11:
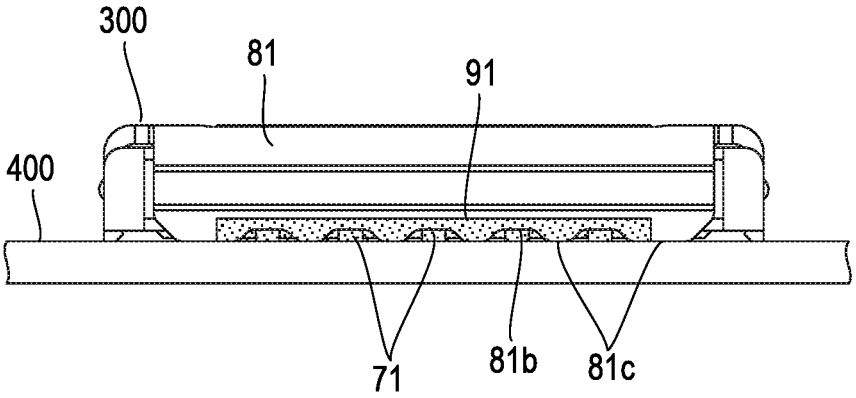
FIG. 11 is a front view showing a state in which the second connector shown in FIG. 9A is mounted on a second board.
Figure 12A:
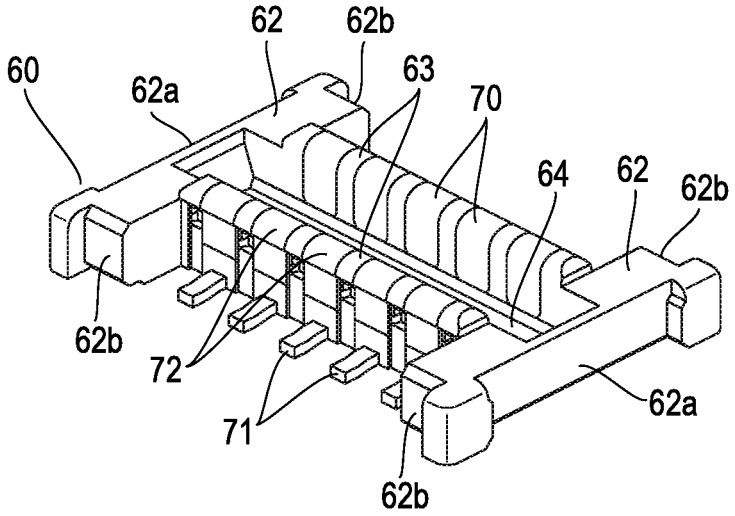
FIG. 12A is a perspective view of a second insulator included in the second connector and second contacts held by the second insulator when viewed from above.
Figure 12B:
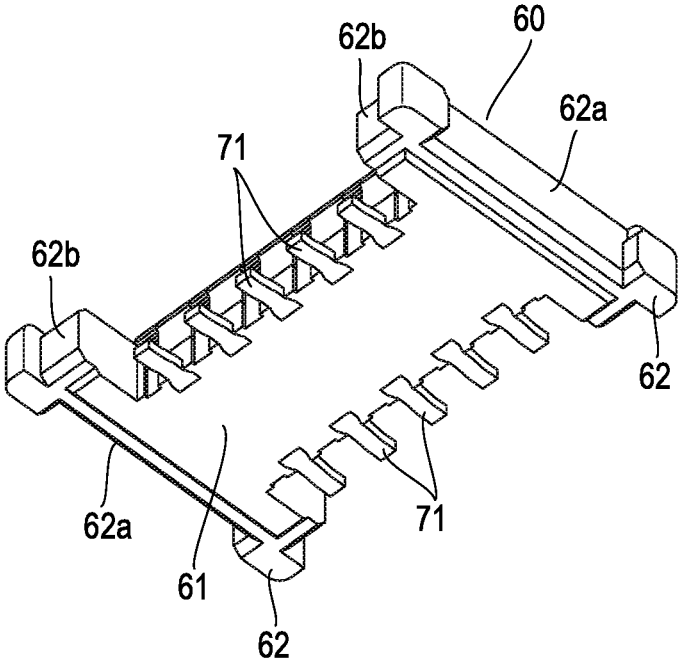
FIG. 12B is a perspective view of the second insulator shown in FIG. 12A when viewed from below.

Although not shown in detail, the end portion 71 of the second contact 70 is soldered to a pad of a second board 400, and the ground connecting portions 81*c* and 82*c* of the side wall portions 81 and the outer wall portions 82 are soldered to a ground pad of the second board 400 (see FIG. 11).

As shown in FIG. 10A, the end portion 71 of the second contact 70 can be viewed from outside the side wall portion 81 through the recessed portion 81*b*. A position or a soldering condition of the end portion 71 can be confirmed, which ensures good mounting of the second connector 300.

After the second connector 300 is mounted on the second board 400, all recessed portions 81*b* and 82*b* of the side wall portions 81 and the outer wall portions 82 are filled with solder. A region denoted by reference numeral 91 in FIG. 11 is a solder region.

(Structure of Connection between First Connector and Second Connector)

A structure of connection between the first connector 100 and the second connector 300 will be described with reference to FIGS. 14A, 14B, 15A, 15B, 15C, and 15D. The first board 200 and the second board 400 are not shown in these drawings.

The second shell 80 of the second connector 300 is fit inside the first shell 50, that is, in a region surrounded by the side wall portions 53 and 54. With this operation, the first connector 100 and the second connector 300 are connected to each other. The central protruding portion 34 of the first insulator 30 in the first connector 100 is fit in the recessed portion 64 of the second insulator 60 in the second connector 300.

One holding wall 63 of the second insulator 60 is inserted between the central protruding portion 34 and one protruding portion 35 of the first insulator 30, and the other holding wall 63 of the second insulator 60 is inserted between the central protruding portion 34 and the other protruding portion 35 of the first insulator 30. As a result, the U-shaped portion 72 of the second contact 70 fits in the U-shaped portion 43 of the first contact 40 (see FIG. 15D). Since the U-shaped portion 72 is sandwiched between the contact portion 44 and the protuberant portion 45, the second contact 70 and the first contact 40 come into contact with each other.

The two side wall portions 81 of the second shell 80 are held between the two side wall portions 53 of the first shell 50. The protruding portion 53*a* of each side wall portion 53 fits in the groove 81*a* of the side wall portion 81 (see FIG. 15D). The side wall portion 53 of the first shell 50 and the side wall portion 81 of the second shell 80 are mechanically locked together. A worker or the like obtains a click feeling when the protruding portion 53*a* of the side wall portion 53 fits in the groove 81*a* of the side wall portion 81. The side wall portion 54 of the first shell 50 and the outer wall portion 82 of the second shell 80 are locked together by contact resistance. That is, contact resistance is generated between the protruding portion 82*a* of the outer wall portion 82 and the side wall portion 54 (see FIG. 15C). The side wall portions 53 and 54 of the first shell 50 and the side wall portions 81 and the outer wall portions 82 of the second shell 80 are locked together, thereby electrically and mechanically connecting the first connector 100 and the second connector 300 to each other.

The above-described embodiment achieves the effects below.

(1) The first shell 50 of the first connector 100 and the second shell 80 of the second connector 300 have no contact pieces surrounded by a void. Thus, electromagnetic waves do not leak through a void, and a potent shielding effect is obtained.

(2) In a state in which the first connector 100 and the second connector 300 fit together, the two protruding portions 53*a* formed at the two side wall portions 53 of the first shell 50 are in contact with the two side wall portions 81 of the second shell 80, and the two protruding portions 82*a* formed at the two outer wall portions 82 of the second shell 80 are in contact with the two side wall portions 54 of the first shell 50. Since a length, over which the first shell 50 and the second shell 80 are in contact with each other, is long, a potent shielding effect is obtained.

(3) The recessed portions 51*a* are filled with solder after the first connector 100 is attached to the first board 200, and the recessed portions 81*b* are filled with solder after the second connector 300 is attached to the second board 400. Thus, electromagnetic waves do not leak through the recessed portions 51*a* and 81*b*, and a potent shielding effect is obtained.

As a modification of the embodiment, a protruding portion may be formed at the side wall portion 81, and a groove, in which the protruding portion is to fit, may be formed in the side wall portion 53, instead of forming the protruding portion 53*a* and the groove 81*a*.

As another modification of the embodiment, a protruding portion may be formed at the side wall portion 54, instead of forming the protruding portion 82*a*.

In the embodiment, the end portion 41 of the first contact 40 corresponds one-to-one to the recessed portion 51*a*, and the end portion 71 of the second contact 70 corresponds one-to-one to the recessed portion 81*b*. However, only one recessed portion 51*a* corresponding to any one end portion 41 of the end portions 41 of the first contacts 40 may be formed. Alternatively, only one recessed portion 81*b* corresponding to any one end portion 71 of the end portions 71 of the second contacts 70 may be formed.

The recessed portions 52*a* and 82*b* are formed in consideration of respective patterns formed at the first board 200 and the second board 400 and are not essential features.

Addendum

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims.

Moreover, the use of the terms "first", "second", "i-th", etc., if any, do not denote any order or importance, but rather the terms "first", "second", "i-th", etc. are used to distinguish one element from another. The term "first" does not necessarily mean "coming before all others in order". The terminology used herein is for the purpose of describing particular embodiments only and is not intended to limit the invention in any way. As used herein, the singular forms "a", "an" and "the" are intended to include the plural forms as well, unless the context clearly indicates otherwise. It will be further understood that the terms "comprise", "comprises", and/or "comprising," when used in this specification and/or the appended claims, specify the presence of stated features, steps, operations, elements, and/or components, but do not preclude the presence or addition of one or more other features, steps, operations, elements, components, and/or groups thereof. The same goes for "include", "includes", and/or "including". The term "and/or", if any, includes any and all combinations of one or more of the associated listed items. In the claims and the specification, unless otherwise noted, "connect", "join", "couple", "interlock", or synonyms therefor and all the word forms thereof, if any, do not necessarily deny the presence of one or more intermediate elements between two elements, for instance, two elements "connected" or "joined" to each other or "interlocked" with each other. Connection between elements, if required, may be physical connection, electrical connection, or a combination thereof. In the claims and the specification, unless otherwise noted, the term "arbitrary", if any, should be understood as a term having the same meaning as the universal quantifier V. For example, the expression "for arbitrary X" has the same meaning as "for every X" or "for each X". Thus, for example, the expression "one arbitrary X of ten Xs" or "one arbitrarily selected X of ten Xs" or an expression similar thereto is not an expression describing one particular X but an expression describing each of ten Xs. For example, the expression "proposition P holds for a pair consisting of one arbitrarily selected X of three Xs and one Y, corresponding to the one selected X, of three Ys" or an expression similar thereto means that the proposition P holds for each of the three pairs (X1, Y1), (X2, Y2), and (X3, Y3) which are generated by one-to-one correspondence between the set (X1, X2, X3) and the set (Y1, Y2, Y3).

Unless otherwise defined, all terms (including technical and scientific terms) used herein have the same meaning as commonly understood by those skilled in the art to which the invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual techniques or steps in an unnecessary fashion. Nevertheless, the specification and claims should be read with the understanding that such combinations are entirely within the scope of the invention and the claims.

The corresponding structures, materials, acts, and equivalents of all means or step plus function elements in the claims below, if any, are intended to include any structure, material, or act for performing the function in combination with other claimed elements as specifically claimed.

The foregoing description of the embodiments of the invention has been presented for the purpose of illustration and description. It is not intended to be exhaustive and to limit the invention to the precise form disclosed. Modifications or variations are possible in light of the above teaching. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A board-to-board connector comprising:

a first connector to be attached to a first board; and a second connector to be attached to a second board, wherein the first connector includes a first insulator, a first contact which is held by the first insulator, and a first shell which has conductivity, the first shell includes four side wall portions and four outer wall portions, the four side wall portions of the first shell each link with a peripheral edge of one corresponding outer wall portion of the four outer wall portions and are located inside the four outer wall portions, the first shell is attached to the first insulator as an outer shell of the first connector, the second connector includes a second insulator, a second contact which is held by the second insulator, and a second shell which has conductivity, the second shell includes four side wall portions, the second shell is attached to the second insulator as an outer shell of the second connector, in a state in which the first connector and the second connector are connected to each other, the second shell is fit inside the four side wall portions of the first shell, and the four side wall portions of the first shell and the four side wall portions of the second shell are in one-to-one contact with each other, and for a pair consisting of one arbitrarily selected side wall portion of the four side wall portions of the first shell and one side wall portion, corresponding to the one selected side wall portion, of the four side wall portions of the second shell, one side wall portion of the pair has a protruding portion which extends linearly along the one side wall portion, and the other side wall portion of the pair does not have the protruding portion.

2. The board-to-board connector according to claim 1, wherein two side wall portions facing each other of the four side wall portions of the first shell are spring pieces.

3. The board-to-board connector according to claim 2, wherein the other side wall portion, corresponding to the one side wall portion that is the spring piece, has a groove to hold the protruding portion.

4. The board-to-board connector according to claim 2, wherein two remaining side wall portions facing each other of the four side wall portions of the first shell and two side wall portions, corresponding to the two remaining side wall portions, of the four side wall portions of the second shell are locked together by contact resistance.

5. The board-to-board connector according to claim 3, wherein two remaining side wall portions facing each other of the four side wall portions of the first shell and two side wall portions, corresponding to the two remaining side wall portions, of the four side wall portions of the second shell are locked together by contact resistance.

6. A mounting structure for a board-to-board connector, comprising:

the board-to-board connector;

a first board; and a second board, wherein the board-to-board connector includes a first connector which is attached to the first board, and a second connector which is attached to the second board, the first connector includes a first insulator, a first contact which is held by the first insulator, and a first shell which has conductivity, the first shell includes four side wall portions and four outer wall portions, the four side wall portions of the first shell each link with a peripheral edge of one corresponding outer wall portion of the four outer wall portions and are located inside the four outer wall portions, the first shell is attached to the first insulator as an outer shell of the first connector, the second connector includes a second insulator, a second contact which is held by the second insulator, and a second shell which has conductivity, the second shell includes four side wall portions, the second shell is attached to the second insulator as an outer shell of the second connector, in a state in which the first connector and the second connector are connected to each other, the second shell is fit inside the four side wall portions of the first shell, and the four side wall portions of the first shell and the four side wall portions of the second shell are in one-to-one contact with each other, for a pair consisting of one arbitrarily selected side wall portion of the four side wall portions of the first shell and one side wall portion, corresponding to the one selected side wall portion, of the four side wall portions of the second shell, one side wall portions of the pair has a protruding portion which extends linearly along the one side wall portion, and the other side wall portion of the pair does not have the protruding portion, at least one outer wall portion of the four outer wall portions of the first shell has a first end edge and a first recessed portion formed at the first end edge, the first end edge except for the first recessed portion being in contact with the first board and the first recessed portion being for viewing an end portion of the first contact, at least one side wall portion of the four side wall portions of the second shell has a second end edge and a second recessed portion formed at the second end edge, the second end edge except for the second recessed portion being in contact with the second board and the second recessed portion being for viewing an end portion of the second contact, in a state in which the first connector is attached to the first board, the first recessed portion is filled with solder, and in a state in which the second connector is attached to the second board, the second recessed portion is filled with solder.

7. The mounting structure according to claim 6, wherein the first connector has a third contact which has a same shape as a shape of the first contact, the at least one outer wall portion having the first end edge and the first recessed portion further has a third recessed portion formed at the first end edge, the first end edge except for the first and third recessed portions being in contact with the first board and the third recessed portion being for viewing an end portion of the third contact, and in a state in which the first connector is attached to the first board, the third recessed portion is filled with solder.

8. The mounting structure according to claim 6, wherein the second connector has a fourth contact which has a same shape as a shape of the second contact, the at least one outer wall portion having the second end edge and the second recessed portion further has a fourth recessed portion formed at the second end edge, the second end edge except for the second and fourth recessed portions being in contact with the second board and the fourth recessed portion being for viewing an end portion of the fourth contact, and in a state in which the second connector is attached to the second board, the fourth recessed portion is filled with solder.

9. The mounting structure according to claim 6, wherein two side wall portions facing each other of the four side wall portions of the first shell are spring pieces.

10. The mounting structure according to claim 7, wherein two side wall portions facing each other of the four side wall portions of the first shell are spring pieces.

11. The mounting structure according to claim 8, wherein two side wall portions facing each other of the four side wall portions of the first shell are spring pieces.

12. The mounting structure according to claim 9, wherein the other side wall portion, corresponding to the one side wall portion that is the spring piece, has a groove to hold the protruding portion.

13. The mounting structure according to claim 10, wherein the other side wall portion, corresponding to the one side wall portion that is the spring piece, has a groove to hold the protruding portion.

14. The mounting structure according to claim 11, wherein the other side wall portion, corresponding to the one side wall portion that is the spring piece, has a groove to hold the protruding portion.

15. The mounting structure according to claim 9, wherein two remaining side wall portions facing each other of the four side wall portions of the first shell and two side wall portions, corresponding to the two remaining side wall portions, of the four side wall portions of the second shell are locked together by contact resistance.

16. The mounting structure according to claim 10, wherein two remaining side wall portions facing each other of the four side wall portions of the first shell and two side wall portions, corresponding to the two remaining side wall portions, of the four side wall portions of the second shell are locked together by contact resistance.

17. The mounting structure according to claim 11, wherein two remaining side wall portions facing each other of the four side wall portions of the first shell and two side wall portions, corresponding to the two remaining side wall portions, of the four side wall portions of the second shell are locked together by contact resistance.

18. The mounting structure according to claim 12, wherein two remaining side wall portions facing each other of the four side wall portions of the first shell and two side wall portions, corresponding to the two remaining side wall portions, of the four side wall portions of the second shell are locked together by contact resistance.

19. The mounting structure according to claim 13, wherein two remaining side wall portions facing each other of the four side wall portions of the first shell and two side wall portions, corresponding to the two remaining side wall portions, of the four side wall portions of the second shell are locked together by contact resistance.

20. The mounting structure according to claim 14, wherein two remaining side wall portions facing each other of the four side wall portions of the first shell and two side wall portions, corresponding to the two remaining side wall portions, of the four side wall portions of the second shell are locked together by contact resistance.

* * * * *